US006047843A

United States Patent [19]

Mecke

[11] Patent Number: 6,047,843

[45] Date of Patent: Apr. 11, 2000

[54] COMPARTMENTED RECEPTACLE FOR USE IN RECYCLING AND WASTE DISPOSAL

[76] Inventor: Deirdre L. Mecke, 123 Summit Ave., Fort Washington, Pa. 19034

[21] Appl. No.: 09/354,855

[22] Filed: Jul. 29, 1999

[51] Int. Cl.[7] ..... B65D 21/02; B65F 1/08

[52] U.S. Cl. ..... 220/23.88; 220/909; 220/908.1; 220/908.3; 220/23.4; 232/43.1; 232/43.2

[58] Field of Search ..... 232/43.1, 43.2; 220/909, 908.1, 908.3, 908, 23.83, 23.86, 23.87, 23.88, 507, 503, 523, 524, 555, 552, 23.4, 23.8

[56] References Cited

U.S. PATENT DOCUMENTS

| | | | |
|---|---|---|---|
| 3,510,055 | 5/1970 | Safford . | |
| 3,648,875 | 3/1972 | Lundgren | 220/404 |
| 3,893,615 | 7/1975 | Johnson | 232/43.2 |
| 3,904,218 | 9/1975 | Kostic | 280/79.2 |
| 4,114,776 | 9/1978 | Pluss | 220/531 |
| 4,834,253 | 5/1989 | Crine | 220/1 T |
| 4,905,853 | 3/1990 | Strawder | 220/1 T |
| 4,991,737 | 2/1991 | Edelman | 220/525 |
| 5,097,750 | 3/1992 | Oldham et al. | 454/63 |
| 5,228,591 | 7/1993 | Jones | 220/528 |
| 5,257,577 | 11/1993 | Clark | 100/99 |
| 5,377,907 | 1/1995 | Guard | 232/43.2 |
| 5,525,020 | 6/1996 | Reiling | 414/422 |
| 5,624,050 | 4/1997 | Haas | 220/4.05 |
| 5,662,235 | 9/1997 | Nieto | 220/23 |

*Primary Examiner*—Stephen Castellano
*Attorney, Agent, or Firm*—LaMorte & Associates

[57] ABSTRACT

A receptacle assembly where garbage can be sorted for purposes of recycling. The receptacle assembly includes a main housing that is symmetrically disposed around a central vertical axis. A plurality of internal walls are disposed within the main housing that radially extend from the central axis. The internal walls create compartments within the housing. Doors are disposed within the housing. Each door provides access to one of the compartments within the housing. A plurality of containers are provided, wherein each of the containers is sized to fit within one of the compartments through the door openings. Access openings are disposed either in the lid of the receptacle assembly or in the side surfaces of the main housing. In this manner, different materials can be disposed of in the different compartments of the assembly.

20 Claims, 4 Drawing Sheets

COMPARTMENTED RECEPTACLE FOR USE IN RECYCLING AND WASTE DISPOSAL

BACKGROUND OF THE INVENTION

1. Field of the Invention

In general, the present invention relates to trash and recycling receptacles that are used to collect discarded materials. More specifically, the present invention relates to trash receptacles and recycling receptacles that are compartmented so that discarded items of different materials can be sorted upon disposal into the receptacle.

2. Description of the Prior Art

More and more municipalities are requiring that collected trash be divided between recyclable and non-recyclable materials. One of the most common ways to meet this requirement is to provide different receptacles for different materials. For example, a home can have one trash bin for plastic items, one trash bin for aluminum items and another for non-recyclable trash. As such, by disposing of an item in the proper trash bin, the discarded material automatically is separated for processing by the municipality.

When a municipality collects trash, they often collect different materials at different times and with different trucks. For example, a municipality may collect non-recyclable trash with one garbage truck and collect aluminum and glass with different trucks. In this manner, the presorted materials are not again mixed by the municipality when collected.

In addition to collecting recyclables at their residents' homes, many municipalities are considering collecting recyclables from public locations. One way to do this is to provide compartmented trash cans. Compartmented trash cans have multiple access openings through which trash can be inserted. Each access opening leads to an isolated compartment within the trash can. The different access openings are identified with different materials, such as paper, plastic, aluminum, etc. Accordingly, once people take their trash to the trash can, it takes little additional effort to dispose of the trash in the proper bin.

Compartmented garbage cans are exemplified in the prior art by U.S. Pat. No. 5,662,235 to Nieto, entitled Receptacle For Recyclable Materials; U.S. Pat. No. 5,624,050 to Haas, entitled, Lid And Structural Arrangement For Recycling And Refuse Receptacles; and U.S. Pat. No. 4,905,853 to Strawder, entitled Compartmented Receptacle.

Trash cans used in public places are often unattractive, overflowing with garbage and difficult to locate. Since recycling in public places is not yet widespread, it is often unclear to people whether there exist receptacles for recyclable materials. Even among those few municipalities that provide for recycling in public places, there exists a wide variety of recycling receptacles, ranging from regular trash receptacles relabeled as recycling receptacles to old steel drums with spray-painted indica marking them as recycling collection receptacles. In addition, many of the current recycling receptacles have large waste collection openings that are subject to insects, rodents, overflowing, and flooding from rainfall. Other current recycling receptacles make no allowances for differences in collection times, and force municipal workers to handle all of the collected materials, even though they are seeking to collect only a portion of the recyclables and refuse.

A need therefore exists for an improved, aesthetically pleasing trash receptacle that is convenient to use, simplifies recycling and provides for improved access to the discarded materials for collection. This need is met by the present invention as described and claimed below.

SUMMARY OF THE INVENTION

The present invention is a receptacle assembly where garbage can be sorted for purposes of recycling. The receptacle assembly includes a main housing that is self-supporting. The housing is symmetrically disposed around a central vertical axis in either a cylindrical configuration or a polygonal configuration. A plurality of internal walls radially extend from the central axis to the interior of the housing. The internal walls create generally triangular-shaped compartments within the housing. A plurality of doors are disposed within the housing. Each door provides access to one of the compartments within the housing. A plurality of containers are provided, wherein each of the containers is sized to fit within one of the compartments through a door opening.

Access openings are formed through either the housing of the receptacle assembly or the lid of the receptacle assembly. An access opening is disposed over each compartment so that material passed through an access opening falls into the container within the below lying compartment.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention receptacle assembly can be used to sort many different objects, prior to processing, such as different colored laundry and the like, the present invention system is especially well suited for use as a refuse receptacle. As a result, the exemplary embodiments of the present invention assembly describe its use as a trash refuse receptacle in order to set forth the best mode contemplated for the invention.

Figure 1:
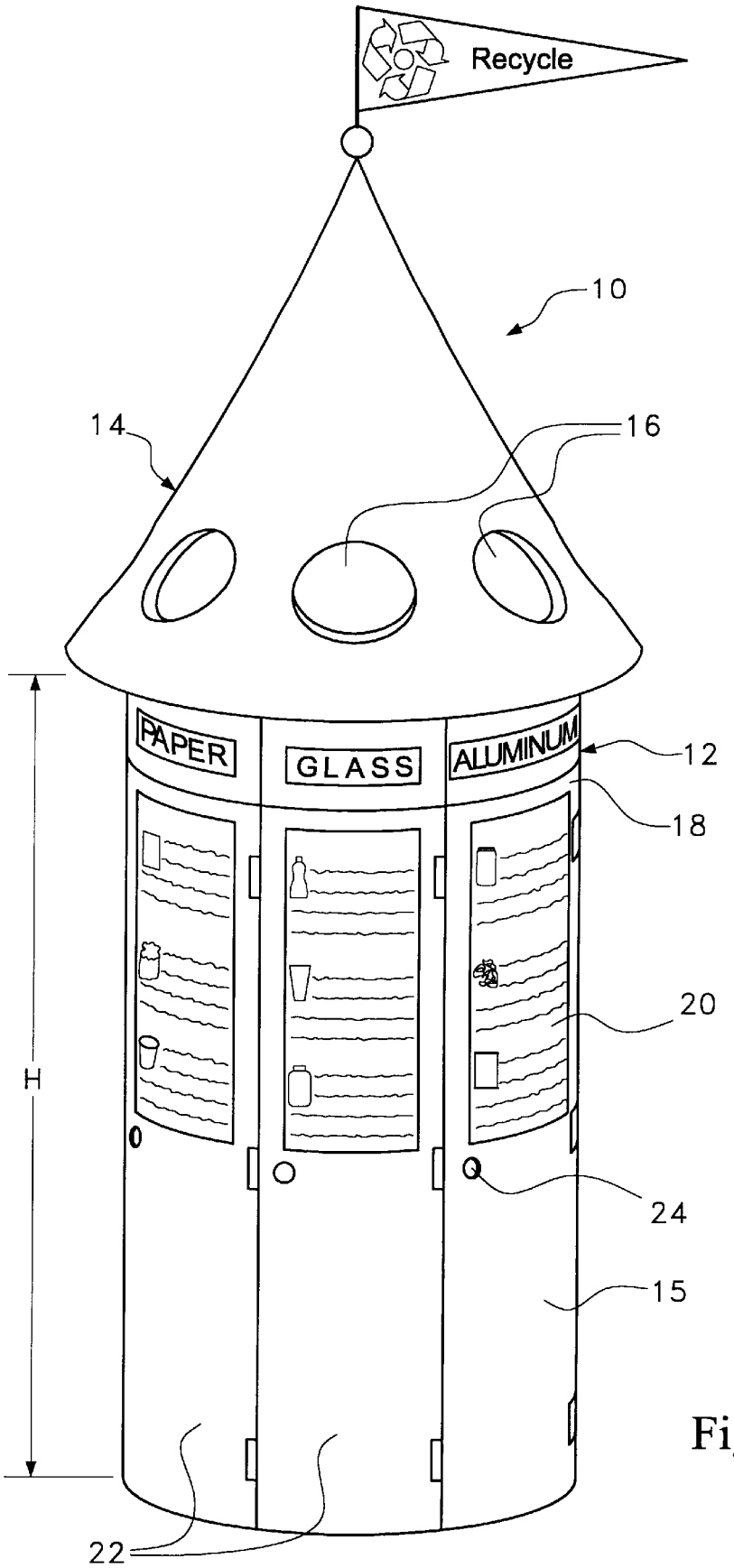
FIG. 1 is a perspective view of an exemplary embodiment of a receptacle assembly in accordance with the present invention.

Referring to FIG. 1, an exemplary embodiment of the present invention receptacle assembly 10 is shown. The receptacle assembly 10 is a self-supporting structure having a cylindrical main housing 12. The exterior of the cylindrical main housing 12 extends from the ground to a predetermined height H, which is preferably between two and six feet high. The cylindrical main housing 12 is divided into equal arcuate sections 15, that form the full cylindrical main housing 12 when combined.

A lid 14 covers the top of the cylindrical housing 12. The lid can have either a polygon-shaped base or a circular base. In the shown embodiment, a lid 14 with a circular base is illustrated. The lid 14 rises to an apex point between one and three feet above the top of the polygon-shaped housing 12. Accordingly the total height of the receptacle assembly 10 can be between three feet and nine feet tall.

Access openings 16 are disposed in the lid 14. An access opening 16 is disposed on the lid 14 above the center of each arcuate segment 15 of the cylindrical main housing 12. An identification indica 18 is located proximate each of the access openings 16. The identification indica 18 either textually and/or graphically depicts a type of waste material, such as paper, plastic, glass, aluminum, non-recyclable trash, newspaper or the like. The selections available correspond to the number of arcuate sections into which the cylindrical main housing 12 is divided. As such, if the cylindrical main housing 12 is divided into six sections, such as is shown, there will be six access openings 16, and thus six possible disposal choices.

In addition to the identification choices, an information sheet 20 can be provided for each of the access openings 16. The information sheet 20 lists common items that should be disposed of through that access opening 16. The list can be textual, graphical and/or pictorial in nature.

Each of the arcuate sections 15 of the cylindrical main housing 12 contains a door 22 that is connected to the substructure of the receptacle assembly 10 with hinges. Each door 22 also contains a latch 24 that holds the door 22 closed until it is required to be opened. Although any known latch can be used, it is preferred that the selected latch be locking so that only authorized personnel can open the doors 22.

Figure 2:
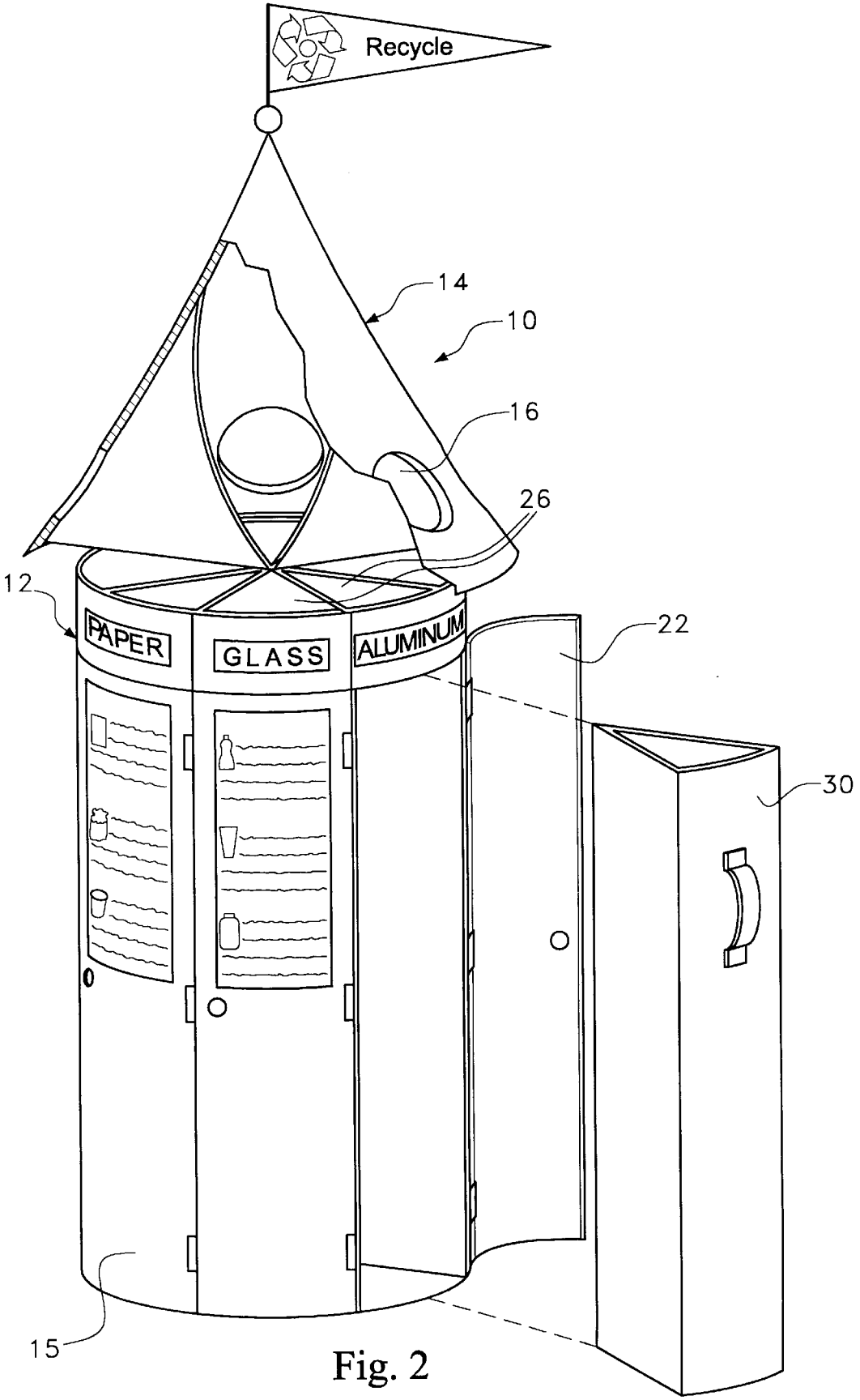
FIG. 2 is a partially fragmented and exploded view of the embodiment of FIG. 1 to better illustrate internal components.

Referring to FIG. 2, it can be seen that the substructure of the housing 12 of the receptacle assembly 10 is segmented and an internal wall 24 extends inwardly from every junction between arcuate sections 15 in the cylindrical main housing 12. All the internal walls 24 of the substructure, converge at the center of the housing 12. The result is a compartmented substructure having a generally triangular-shaped compartment 26 located behind each arcuate segment 15 of the cylindrical main housing 12.

A shaped container 30 is provided behind each door 22 within the various compartments 26. The containers 30 are shaped in the same manner as the compartments 26 so as to maximize the volume of space they occupy within those compartments. Each container 30 has a height less than that of the door 22 and a width that is slightly smaller than the door 22. Accordingly, when the doors 22 are opened, the containers 30 can be readily removed through the door 22.

As material is disposed of through the access openings 16 on the lid 14 of the receptacle assembly 10, that material falls into the container 30 positioned below that opening. Accordingly, if different material is disposed of through the different access openings 16, that material is collected in different containers 30. As such, one container 30 will fill with aluminum, while other containers will fill with glass, plastic, paper, metal, non-recyclables and the like.

When the different municipal collections take place, only the materials being collected at that time need be removed from the receptacle assembly 10. For example, suppose a municipal truck is passing the receptacle assembly 10 that has collected glass and aluminum for recycling. The municipal workers need only open the doors to the compartments 26 that hold the aluminum and glass products. These materials can be removed without disturbing the other materials in the receptacle assembly 10 and without removing the lid 14 to the entire assembly. Accordingly, should the compartment holding non-recyclable waste be infested with bees or be particularly malodorous, it need not be disturbed or exposed until the municipality chooses to collect it.

Figure 3:
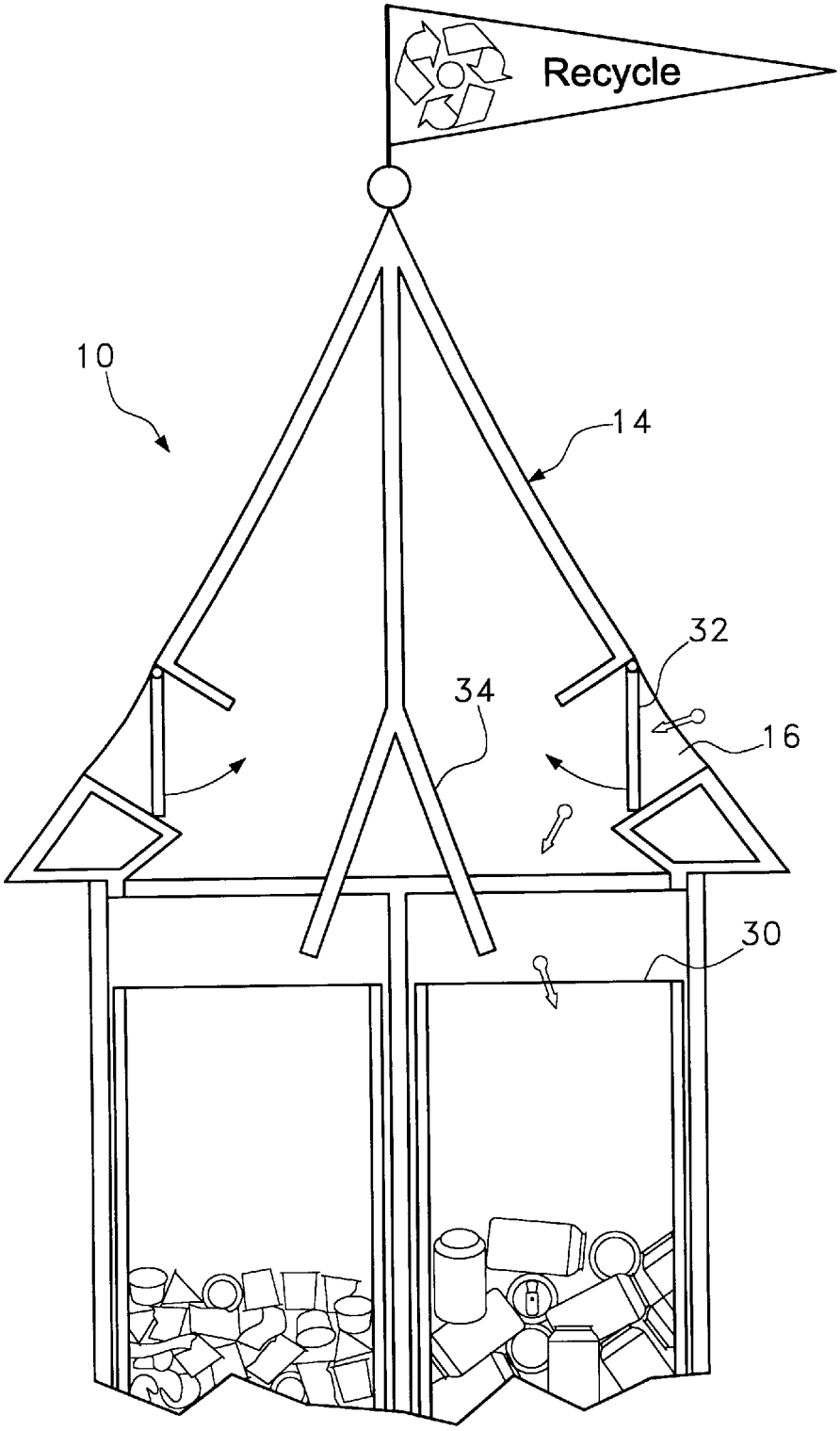
FIG. 3 is a cross-sectional view of a portion of the embodiment shown in FIG. 1.

Referring to FIG. 3, it can be seen that the lid 14 of the receptacle assembly 10 is also segmented into different compartments. The compartments in the lid 14 correspond in position to the compartments in the below cylindrical main housing. Accordingly, when an object is pushed through one of the access openings 16 in the lid 14, that object can not enter any adjacent compartment. Rather, that object has no place to go except into the container 30 positioned below that access opening.

A closure flap 32 may optionally be positioned in each of the access openings 16. The closure flap 32 helps prevent bugs and animals from accessing the interior of the receptacle assembly 10. Furthermore, the closure flaps 32 limit air flow past the interior of the receptacle assembly 10 so as to reduce the degree of odor released into the air by the materials within the receptacle assembly 10.

To better guide any material down into the below lying containers 30, deflection plates 34 may also be present inside the lid 14. The deflection plates 34 help gravity guide any material introduced through an access opening 16 into the wider portion of the below lying container 30.

In the embodiments of FIG. 1, FIG. 2 and FIG. 3, a pennant extends from the apex of the lid. The pennant shows a recycling symbol of some type so that people can easily recognize the receptacle assembly as a place where trash can be recycled.

Figure 4:
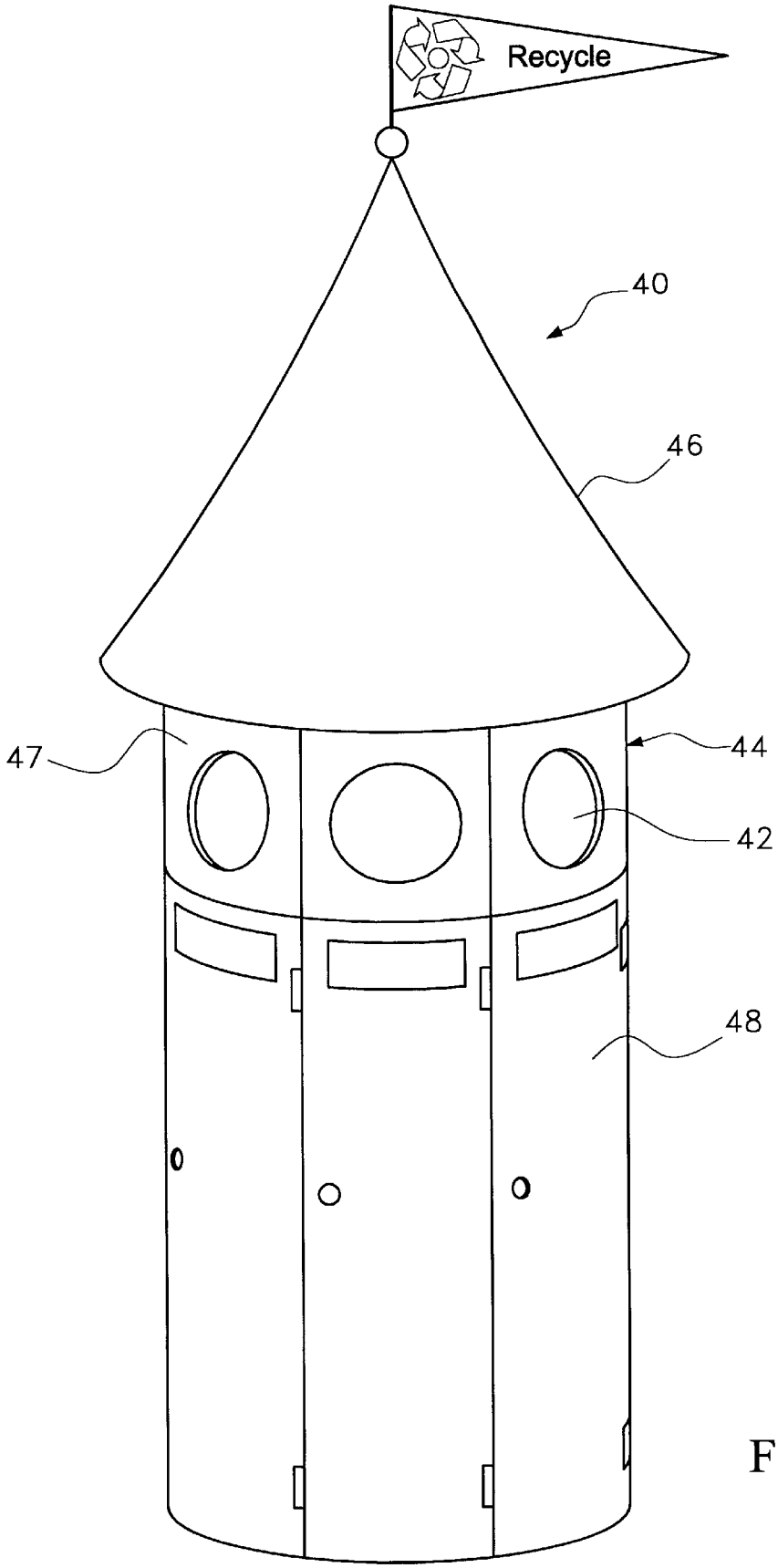
FIG. 4 is a perspective view of an alternate embodiment of the present invention.

Referring to FIG. 4, an alternate embodiment of the present invention 40 is shown. In this embodiment, both an alternate embodiment of a lid shown and an alternate embodiment of a main housing are shown.

The lid 46 is different in that there are no access openings in the lid 46. Rather, the access openings 42 are located on the flat side surfaces 47 of a polygon-shaped main housing 44. By placing the access openings 42 on the sides of the receptacle assembly 40 rather than on the lid 46 of the assembly 40, the lid 46 of the assembly can be made more rain resistant. Accordingly, when it rains, the lid 46 protects the access openings 42 and water does not enter the receptacle assembly 40.

Each of the flat side surfaces 47 of the polygon-shaped housing 44 contains a door 48 that is connected to the substructure of the receptacle assembly 40 with hinges. Each door 48 also contains a lockable latch 50 that holds the door 48 closed until it is required to be opened. The doors 48 extend up the side of the polygon-shaped housing 44 to a height just below that of the access openings 42.

Within the polygon-shaped housing 44, are triangular-shaped containers (not shown). The containers lay just below the access openings 42 and catch any material inserted through the access openings 42. When full, the containers are removed from the receptacle assembly through the doors 48.

It will be understood that the embodiments of the present invention described and illustrated herein are merely exemplary and a person skilled in the art can make many variations to the embodiment shown without departing from the scope of the present invention. For example, the main body of the invention can have any polygonal shape and the access openings can be positioned at different points on the lid of the assembly and on the sides of the assembly. All such variations, modifications and alternate embodiments are intended to be included within the scope of the present invention as defined by the appended claims.

What is claimed is:

1. A receptacle assembly, comprising:

a housing having a top, a bottom and a predetermined length therebetween, wherein said housing is symmetrically disposed around a central axis;

a plurality of internal walls within said housing, wherein said internal walls radially extend from said central axis and create a plurality of compartments within said housing;

a plurality of doors disposed within said housing, wherein each said door provides access to one of said compartments in said housing;

a plurality of containers sized to fit within said compartments, wherein each container is removable from housing through said door;

a lid for covering said top of said housing; and access openings defined by said lid, wherein an access opening is disposed in said lid over each of said compartments.

2. The assembly according to claim 1, wherein said lid is pitched, having an apex point and a peripheral edge, wherein said lid slopes upwardly from said peripheral edge to said apex point.

3. The assembly according to claim 1, wherein said housing is cylindrical in shape between said top and said bottom.

4. The assembly according to claim 1, wherein said housing is polygonal in shape between said top and said bottom.

5. The assembly according to claim 1, further including identifying indica proximate each of said access openings for identifying each of said access openings with a type of disposable material.

6. The assembly according to claim 5, wherein said disposable material identified by said identifying indica is selected from a group consisting of paper, newspaper, aluminum, glass, plastic, metal and non-recyclable material.

7. The assembly according to claim 1, further including a directional indica for each access opening that lists items that should be placed within that access opening.

8. The assembly according to claim 2, wherein said lid is compartmented into a plurality of different internal chambers and each of said access openings extends into one of said internal chambers.

9. The assembly according to claim 1, further including a closure flap disposed within each of said access openings.

10. The assembly according to claim 8, wherein a deflection plate is disposed within said lid below each of said access openings, wherein said deflection plate guides material inserted through an access opening into one of said compartments below that access opening.

11. The assembly according to claim 1, wherein said predetermined height is between two and six feet.

12. A receptacle assembly, comprising:

a housing having a top and a bottom, wherein said housing is symmetrically disposed around a central axis;

a plurality of internal walls radially extending from said central axis to said housing, wherein said internal walls create a plurality of compartments within said housing;

a plurality of doors disposed within said housing, wherein each said doors provides access to one of said compartments within said housing;

a plurality of access openings disposed within said side surfaces, wherein an access opening is disposed over each of said doors and provides an opening through which material can be introduced into said compartments behind each of said doors;

a plurality of containers sized to fit within said compartments; and a lid for covering said top of said housing.

13. The assembly according to claim 12, wherein said lid is pitched, having an apex point and a peripheral edge, wherein said lid slopes upwardly from said peripheral edge to said apex point.

14. The assembly according to claim 12, further including identifying indica proximate each of said access openings for identifying each of said access openings with a type of disposable material.

15. The assembly according to claim 14, wherein said disposable material identified by said identifying indica is selected from a group consisting of paper, newspaper, aluminum, glass, plastic, metal and non-recyclable material.

16. The assembly according to claim 12, further including a directional indica for each access opening that lists items that should be placed within that access opening.

17. The assembly according to claim 12, further including a closure flap disposed within each of said access openings.

18. The assembly according to claim 17, wherein a deflection plate is disposed within said compartment below each of said access openings, wherein said deflection plate guides material inserted through an access opening to into one of said compartments.

19. The assembly according to claim 12, wherein said housing has a cylindrical shape.

20. The assembly according to claim 12, wherein said housing has a polygonal shape.

* * * * *